US009234408B2

(12) United States Patent
Fowler, Jr. et al.

(10) Patent No.: US 9,234,408 B2
(45) Date of Patent: Jan. 12, 2016

(54) SYSTEMS AND METHODS FOR OPTIMIZED WELL CREATION IN A SHALE FORMATION

(71) Applicant: Halliburton Energy Services, Inc., Houston, TX (US)

(72) Inventors: Stewart H. Fowler, Jr., Spring, TX (US); Amit Sharma, Richmond, TX (US); Curtis E. Wendler, Spring, TX (US); Keith E. Holtzman, Arvada, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/240,578

(22) PCT Filed: Feb. 21, 2013

(86) PCT No.: PCT/US2013/027115
§ 371 (c)(1),
(2) Date: Feb. 24, 2014

(87) PCT Pub. No.: WO2014/130036
PCT Pub. Date: Aug. 28, 2014

(65) Prior Publication Data
US 2015/0068735 A1 Mar. 12, 2015

(51) Int. Cl.
*E21B 41/00* (2006.01)
*E21B 43/26* (2006.01)
*E21B 7/00* (2006.01)

(52) U.S. Cl.
CPC ..... *E21B 41/0092* (2013.01); *E21B 7/00* (2013.01); *E21B 43/26* (2013.01)

(58) Field of Classification Search
CPC ..... E21B 43/26; E21B 47/00; E21B 49/00
See application file for complete search history.

(56) References Cited

U.S. PATENT DOCUMENTS

| | | | | |
|---|---|---|---|---|
| 2,303,090 | A | 11/1942 | Pranger | |
| 3,648,777 | A | 3/1972 | Aterbury et al. | |
| 4,047,569 | A | 9/1977 | Tagirov et al. | |
| 5,394,941 | A * | 3/1995 | Venditto et al. | 166/255.2 |

(Continued)

FOREIGN PATENT DOCUMENTS

WO 2011/044012 4/2011

OTHER PUBLICATIONS

International Search Report and Written Opinion issued in related International Application No. PCT/US2013/027115, mailed Nov. 18, 2013, 11 pages.

(Continued)

*Primary Examiner* — Jennifer H Gay
(74) *Attorney, Agent, or Firm* — Scott H. Brown; Baker Botts L.L.P.

(57) ABSTRACT

An example method may include determining a first planned stimulation location within the formation. The first planned stimulation location may be based, at least in part, on a predetermined model of a formation. A borehole in the formation may be drilled with a downhole tool. The first planned stimulation location may be adjusted based, at least in part, on data received at the downhole tool. Additionally, the downhole tool may stimulate the formation at the adjusted first planned stimulation location. A second stimulation location also may be determined based on data received at the downhole tool after stimulation of the formation at the adjusted first planned stimulation location.

15 Claims, 5 Drawing Sheets

(56) References Cited

U.S. PATENT DOCUMENTS

| | | | | |
|---|---|---|---|---|
| 7,234,542 | B2 | 6/2007 | Vail | |
| 7,475,742 | B2 | 1/2009 | Angman et al. | |
| 7,624,820 | B2 | 12/2009 | Angman et al. | |
| 7,845,431 | B2 | 12/2010 | Eriksen et al. | |
| 8,186,457 | B2 | 5/2012 | Boyle | |
| 8,714,244 | B2 * | 5/2014 | Conkle et al. | 166/250.1 |
| 2004/0084189 | A1 | 5/2004 | Hosie et al. | |
| 2004/0118613 | A1 | 6/2004 | Vail | |
| 2004/0206494 | A1 * | 10/2004 | Stephenson et al. | 166/250.1 |
| 2005/0230107 | A1 * | 10/2005 | McDaniel et al. | 166/249 |
| 2007/0284106 | A1 | 12/2007 | Kalman et al. | |
| 2008/0202755 | A1 | 8/2008 | Henke et al. | |
| 2008/0264690 | A1 | 10/2008 | Khan et al. | |
| 2009/0151938 | A1 | 6/2009 | Conkle et al. | |
| 2010/0307755 | A1 * | 12/2010 | Xu et al. | 166/308.1 |
| 2011/0024121 | A1 * | 2/2011 | Skeates et al. | 166/308.1 |
| 2012/0043079 | A1 * | 2/2012 | Wassouf et al. | 166/250.01 |
| 2012/0179444 | A1 * | 7/2012 | Ganguly et al. | 703/10 |
| 2012/0186816 | A1 | 7/2012 | Dirksen et al. | |
| 2012/0199346 | A1 * | 8/2012 | Patel et al. | 166/278 |
| 2012/0211241 | A1 * | 8/2012 | Williamson et al. | 166/373 |
| 2012/0232872 | A1 * | 9/2012 | Nasreldin et al. | 703/10 |
| 2013/0140031 | A1 * | 6/2013 | Cohen et al. | 166/308.1 |
| 2013/0231910 | A1 * | 9/2013 | Kumar et al. | 703/10 |
| 2013/0304444 | A1 * | 11/2013 | Strobel et al. | 703/10 |
| 2014/0151035 | A1 * | 6/2014 | Cohen et al. | 166/250.15 |
| 2014/0222405 | A1 * | 8/2014 | Lecerf et al. | 703/10 |
| 2014/0262240 | A1 * | 9/2014 | Boone et al. | 166/250.01 |
| 2014/0299315 | A1 * | 10/2014 | Chuprakov et al. | 166/250.1 |

OTHER PUBLICATIONS

International Preliminary Report on Patentability issued in related PCT Application No. PCT/US2013/027115, mailed Sep. 3, 2015 (8 pages).

* cited by examiner

SYSTEMS AND METHODS FOR OPTIMIZED WELL CREATION IN A SHALE FORMATION

CROSS-REFERENCE TO RELATED APPLICATION

This application is a U.S. National Stage Application of International Application No. PCT/US2013/027115 filed Feb. 21, 2013, and which is hereby incorporated by reference in its entirety.

BACKGROUND

The present disclosure relates generally to well drilling and hydrocarbon recovery operations and, more particularly, to systems and methods for optimized well creation in a shale formation.

Shale formations have become increasingly important in hydrocarbon recovery, as the global prices of oil and gas have increased. Hydrocarbon extraction from shale formations is typically expensive, however, and therefore has relatively small profit margins. In typical drilling operations, a borehole may be drilled separately from stimulation and completion operations. This increases the time and cost of the drilling operations generally. Additionally, by separating the drilling, stimulation and completion operations, it can be difficult to dynamically modify stimulation operations based on downhole conditions. This also increase the overall time and cost of the operations.

FIGURES

Some specific exemplary embodiments of the disclosure may be understood by referring, in part, to the following description and the accompanying drawings.

Figure 1:
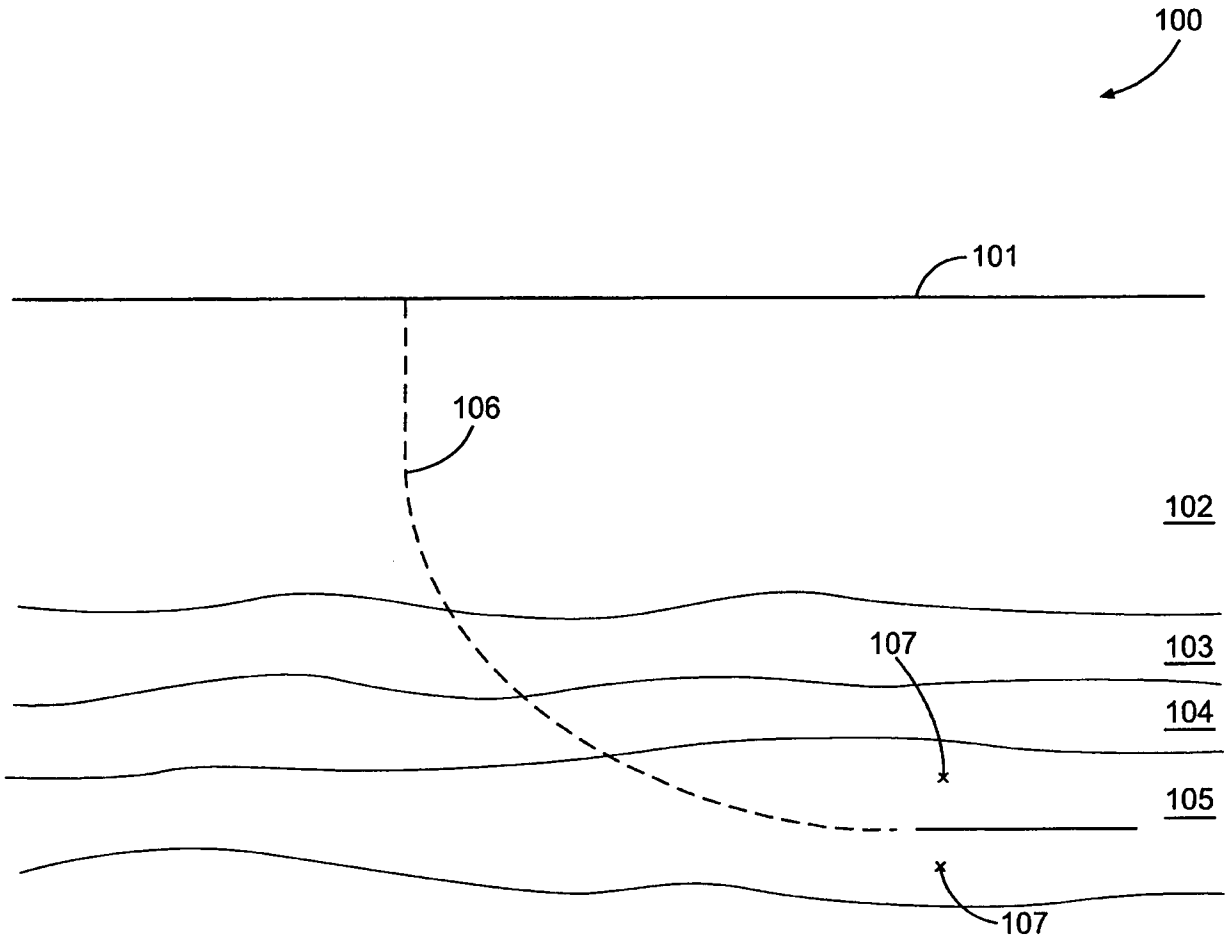
FIG. 1 illustrates an example well plan, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling and hydrocarbon recovery operations and, more particularly, to systems and methods for optimized well creation in a shale formation.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Certain embodiments may be applicable, for example, to logging data acquired with wireline, slickline, and LWD. Embodiments described below with respect to one implementation are not intended to be limiting.

According to embodiments of the present disclosure, systems and methods for optimized well creation in a shale formation are described herein. The method may include determining a first planned stimulation location within the formation. The first planned stimulation location may be based, at least in part, on a pre-determined model of a formation. A borehole in the formation may be drilled with a downhole tool. The first planned stimulation location based, at least in part, on data received at the downhole tool. Additionally, the downhole tool may stimulate the formation at the adjusted first planned stimulation location. In certain other embodiments, a second stimulation location may be determined based on data received at the downhole tool after stimulation of the formation at the adjusted first planned stimulation location.

FIG. 1 illustrates an example well plan 100, according to aspects of the present disclosure. As can be seen, the well plan 100 may comprise a projected well path 106 within a formation 102. The well path 106 may begin at the surface 101 and proceed along a pre-determined path through strata 103, 104, and 105. The well plan 100 may further comprise a planned stimulation location 107 within strata 105. Stimulation operations may include, but are not limited to, fracturing the formation and perforating the formation. As will be appreciated by one of ordinary skill in the art in view of this disclosure, the well plan 100 may be based, at least in part, on a set of a-priori data that is collected before well drilling is commenced. This set of a-priori data may include formation survey data from an offset wellbore, seismic data from surface 101, logging data from other production wellbores within the formation 102, modeling software, previous experience with the formation 101, etc. This set of a-priori data may be used to determine a stratum of interest, such as the strata 105 to which the well path 106 should be directed and landed. Additionally, the set of a-priori data may be used to determine the planned stimulation location 107 for at least one fracture or perforation operation. The planned stimulation location 107 may be selected, for example, to maximize hydrocarbon recovery, to minimize data to surrounding strata, etc. Other selection criteria may be used, as would be appreciated by one of ordinary skill in view of this disclosure.

Once the well plan 100 is determined, the drilling, stimulation, and completion operations may be commenced. Typically, the drilling operations are completed first. Drilling operations may include introducing a drill string and drilling assembly into the formation. In certain embodiments, the drilling assembly may comprise a drill bit that is either driven by the drill string or is driven by a downhole motor. The drilling assembly may also comprise logging and measurement apparatuses which log the formation 102 and other strata 103, 104 and 105 while the well is being drilled. Once the drilling is completed, the drill string and drilling assembly may be retrieved to the surface, and the borehole may be completed by cementing a casing in place. A separate stimulation tool may then be lowered downhole to perforate the casing and fracture the formation.

Figure 2:
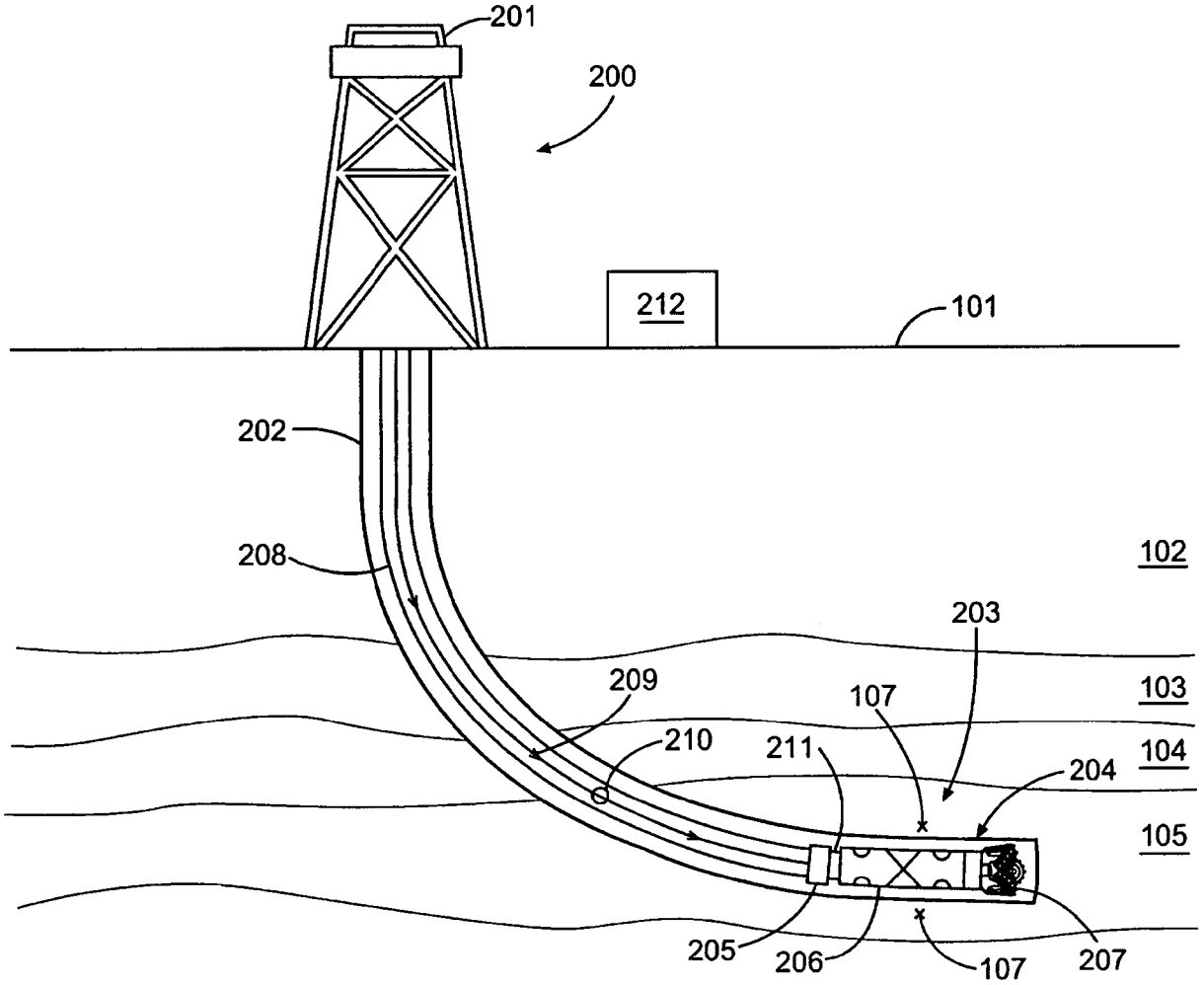
FIG. 2 illustrates an example drilling and completion operation, according to aspects of the present disclosure.

FIG. 2 illustrates an example drilling and completion operation 200, according to aspects of the present disclosure. As will be appreciated by one of ordinary skill in the art in view of this disclosure and described below, the example drilling and completion operation may combine multiple steps in the drilling and completion process as well as provide a mechanism to alter the well plan in real time. This may reduce the time and expense of drilling and completion operations overall, as well as increase the effective hydrocarbon output and the longevity of the formation being drilled. As can be seen, the drilling and completion operation 200 may include a rig 201 positioned at the surface 101 above a borehole 202 within the formation 102. The borehole 202 may follow the well path 106 illustrated in FIG. 1. The rig 201 may be coupled to a downhole tool 203 positioned within the borehole 202. In certain embodiment, the downhole tool 203 may be coupled to the rig via a drill string 208. In certain other embodiments, the downhole tool may be coupled to the rig via a wireline or slickline, for example.

The downhole tool 203 may comprise a bottom hole assembly (BHA) 204 and a stimulation assembly 205. The BHA 204 may comprise a drill bit 207 and a LWD/MWD section 206 that may log the formation 102 and strata 103-105 both while the borehole 202 is being drilled, and after the well is drilled to optimize the fracture locations, as will be described below. In certain embodiments, the drill string 208 may rotate and drive the drill bit 207. In certain other embodiments, the BHA 207 may further include a downhole mud motor that drives the drill bit 207. In such embodiments, the stimulation tool 205 and BHA 204 may be connected to the surface via a slickline. In either embodiment, the BHA 204 may communicate with the control unit 212 positioned at the surface. The control unit 212 may comprise a process and memory device that may contain a set of instructions that cause the processor to receive measurements and logging outputs from the LWD/MWD section 206 and output commands to downhole equipment. As will be described below, the control unit 212 may also contain instruction that cause the processor to alter the well plan, including the planned stimulation location 107, by comparing the real-time measurements and logging outputs of the LWD/MWD section 206 with the a-priori model.

Drilling mud 209 may be pumped downhole during drilling operations and may exit the drill string through ports in the drill bit 207, carrying cuttings to the surface in the annulus between the drill string 208 and the borehole 202. After the borehole 202 has been drilled to a particular location, drilling operations may cease. The borehole then may be optionally "cleaned" by circulating clean fluid within the drill string and through the drill bit to circulate the drilling mud to the surface. This may prevent the formation from being damaged by the drilling fluid.

According to aspects of the present disclosure, once the drilling has ceased, the BHA may be isolated from the stimulation assembly 205 within the downhole tool 203. In certain embodiments, the stimulation assembly 205 may be coupled to the BHA 204 through an isolation assembly 211. The BHA 204 may be isolated using a ball 210 that is dropped within a downward flowing fluid 209 and seats within the isolation assembly 211. By isolating the BHA 204, the pressure of the downward flowing fluid 209 may be increased and ejected through the stimulation assembly 205 for stimulation operations. Although a ball 210 and isolation assembly 211 are described herein as one mechanism by which to isolate the BHA 204, other mechanisms are possible, including a variety of electrically controlled valves.

As will be appreciate by one of ordinary skill in the art in view of this disclosure, by isolating the BHA 204 from the drill string 208, the downhole tool 203 may be converted from a drilling apparatus to a completion apparatus. In particular, with the BHA 204 isolated, the stimulation assembly 205 of the downhole tool 203 may be used to fracture the formation 102, including strata 105, immediately after drilling is completed, without having to run an additional tool downhole.

In certain embodiments, the formation 102 may be fractured as the downhole tool 203 is being withdrawn from the borehole 202, further reducing the operation time. Moreover, as will be described below, the LWD/MWD section 206 of the drilling and completion assembly 203 may continue to log the formation 102 after fracturing operations. Continuing to log the data in real-time, after a fracture operation has been completed, the logging data can be used to ensure that the fractures were successful, to either exclude fractures from the well plan, or to add additional fracture locations, depending on the real-time measurements.

Figure 3:
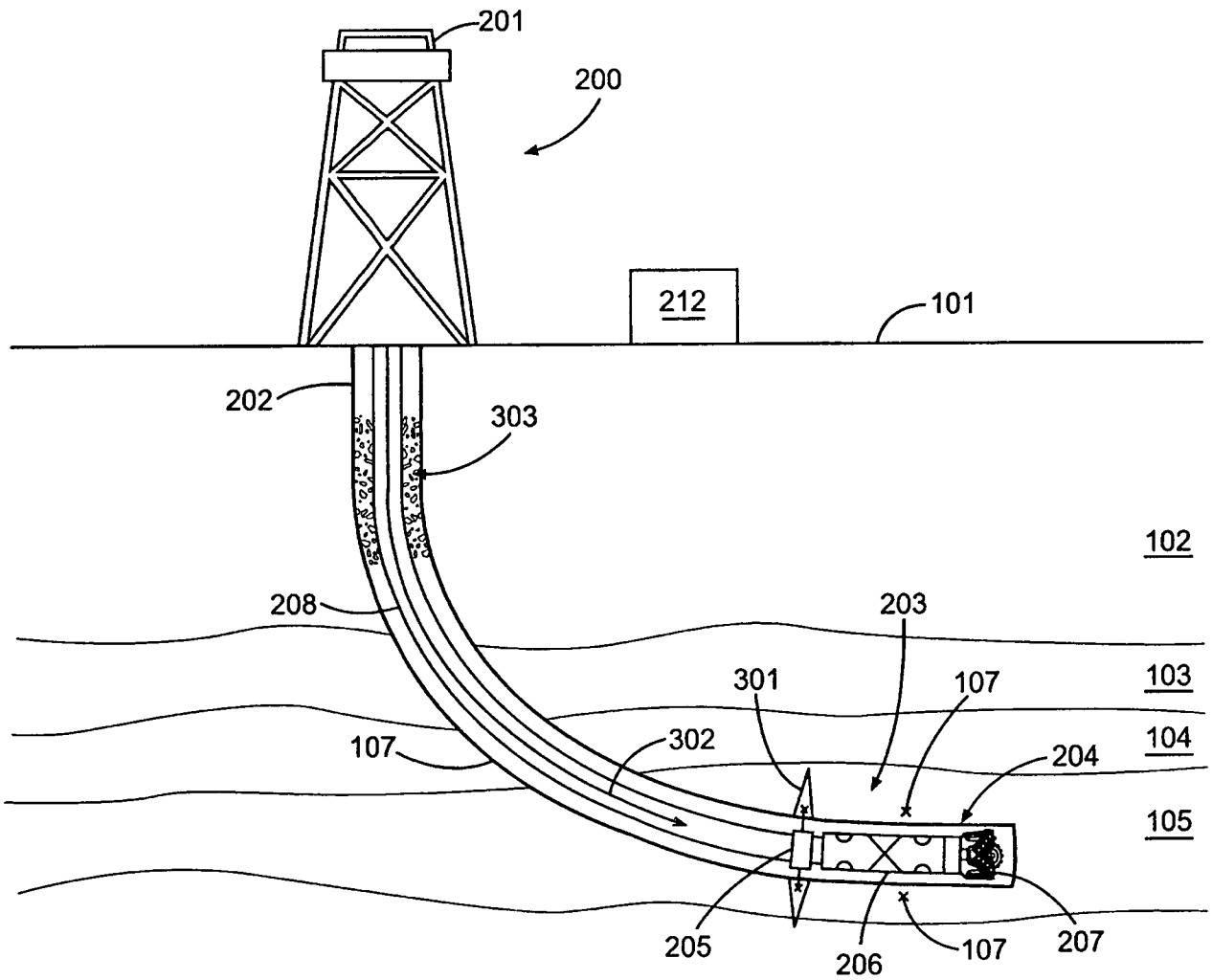
FIG. 3 illustrates an example drilling and completion operation, according to aspects of the present disclosure.

FIG. 3 illustrates an example drilling and completion operation 200; according to aspects of the present disclosure, where the BHA 204 of the downhole tool 203 has been isolated, and the stimulation assembly 205 is fracturing the strata 105 of formation 102. The stimulation assembly 205 may comprise a hydrajet tool, or another fracturing/stimulation tool that would be appreciated by one of ordinary skill in the art in view of this disclosure. In the embodiment shown, high-pressure fluid 302 may be pumped in the drill string 208 from the surface 101. The high pressure fluid 302 may exit the stimulation assembly 205 and cause fracture 301 in the strata 105. Additionally, proppants 303 may be introduced into the annulus between the drill string 208 and the borehole 202, or through the drill string 208, and may be introduced into the fracture 301 and/or isolate the fracture once it is completed.

As can be seen, the location of the fracture 301 is different from the planned stimulation location 107 from the well plan 100. Notably, as the borehole 202 was being drilled, the LWD/MWD section 206 may have logged and measured the formation 102 and transmitted the results to the control unit 212 via a telemetry system, for example. The control unit 212 may then have compared the results to the a-priori data described, and updated formation models with the results. The control unit 212 may then have determined an alternative location for the fracture instead of location 107, to optimize the formation response and hydrocarbon recovery.

Figure 4:
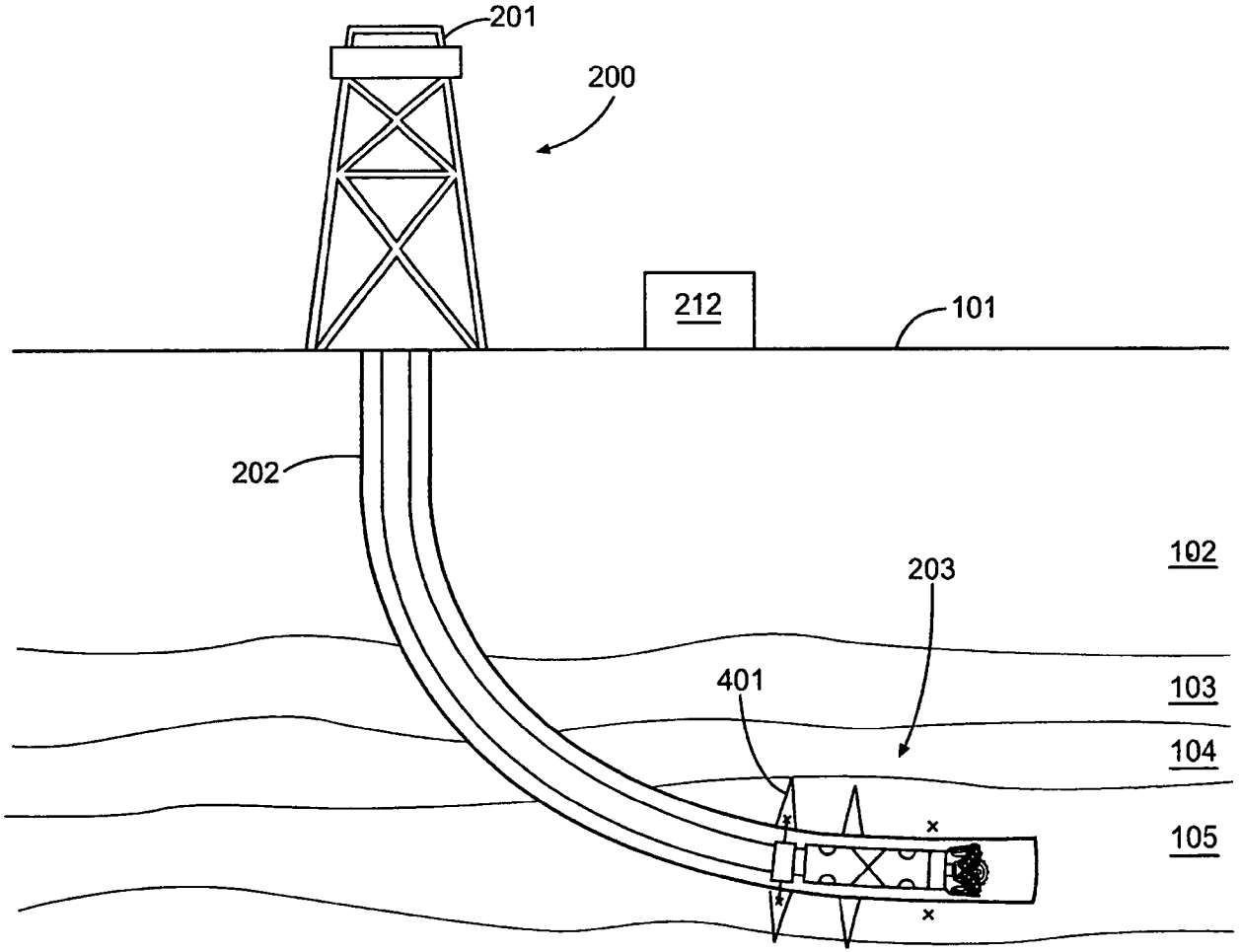
FIG. 4 illustrates an example drilling and completion operation, according to aspects of the present disclosure.

In addition to altering the location 107 of the fracture from the well plan, the control unit 212 may also determine that another fracture is needed to optimize the recovery and identify a location for the additional fracture. Notably, this determination can be made on the results of the logging and measurements taken during drilling operations. Additionally, the determination may be made based on formation logs and measurements that are taken after fracture 301 has been created. Once the fracture 301 has been created, the drilling and completion assembly may be moved toward the surface 101. As the assembly is withdrawn, the LWD/MWD segment 206 may continue to log and measure the formation. These measurements may reflect the relative success of the fracture 301. Based on the relative success of the fracture 301, for example, an additional fracture may be created. FIG. 4, for example, illustrates the drilling and completion assembly 203 fracturing the formation at a second location 401. As will be appreciated by one of ordinary skill in the art in view of this disclosure, the fracture 401 may be created as the assembly 203 is being withdrawn from the borehole 202, reducing the operation time. Additionally, although one additional fracture 401 is shown, multiple additional fractures may be created in multiple locations.

Figure 5:
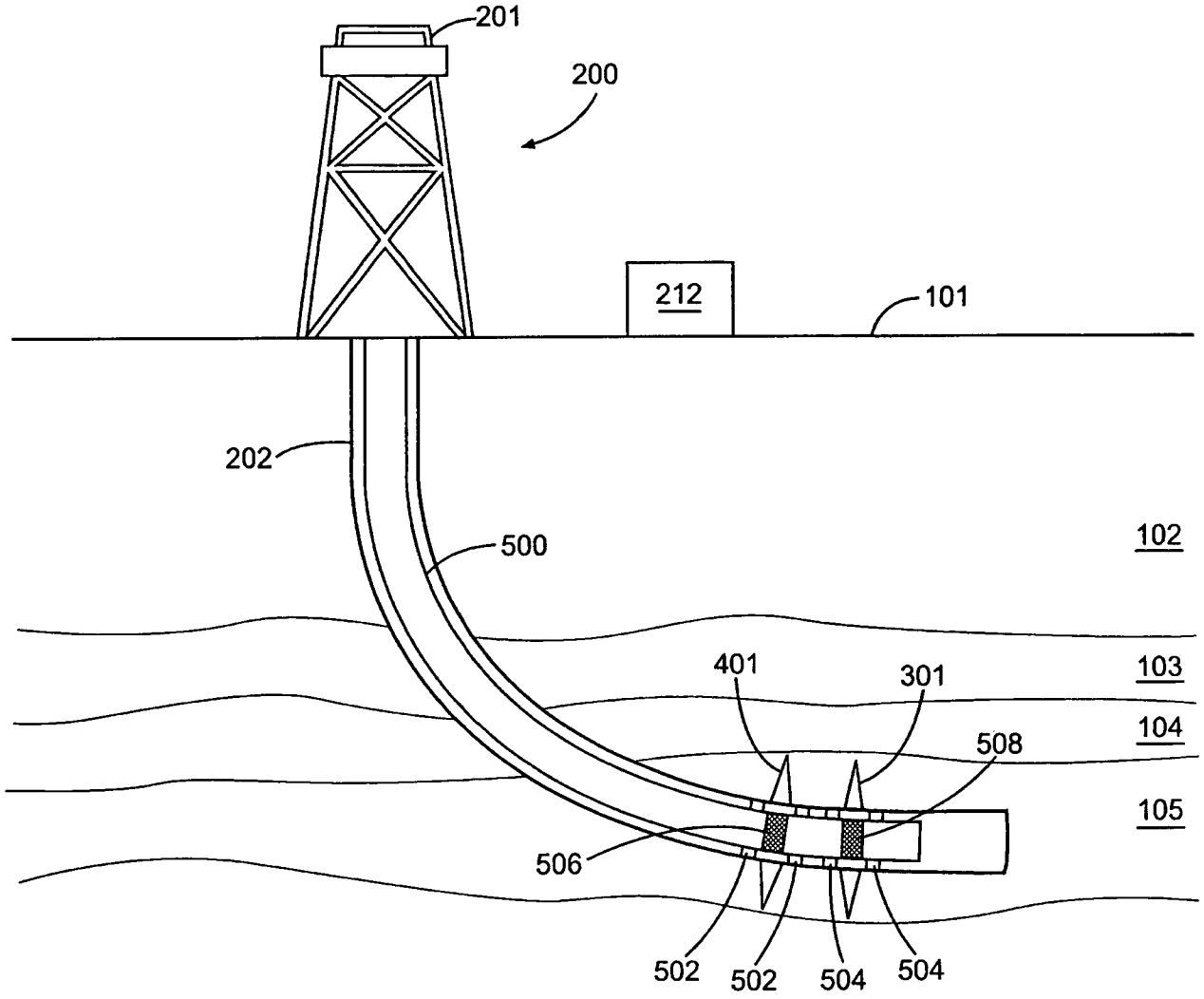
FIG. 5 illustrates an example drilling and completion operation, according to aspects of the present disclosure.

As can be seen in FIG. 5, once the fractures 301 and 401 have been completed and the drilling and completion apparatus 203 removed from the borehole 202, a completion string 500 may be introduced into the borehole 202. Although only two fractures 301 and 401 and stages are shown for ease of explanation, operations incorporating aspects of this disclosure may be used to create dozens of fractures, over many formation strata is multiple stages. As can be seen, the completion string may be configured according to the fracture locations 301 and 401 in the formation 102. For example, the completion string 500 may comprise swell packers 502 disposed on either side of the fracture 401, isolating the fracture from the exterior of the completion string 500. Likewise, the completion string 500 may comprise swell packers 504 disposed on either side of fracture 301, isolating the fracture from the exterior of the completion string 500. Notably, the completion string 500 may have openings 506 and 508 proximate to fractures 401 and 301, respectively, that allow hydrocarbons to enter the interior of the completion string 500 to be collected at the surface.

As will be appreciated by one of ordinary skill in the art in view of this disclosure, the location of the swell packers and openings may be modified as needed before the completion string 500 is introduced into the borehole 202, depending on the location and configuration of the fractures. Likewise, in certain embodiments, the completion string 500 may include smart elements, such as inflow control devices and controllable sleeves that may prolong the useful like of the formation by limiting the flow of fluids.

According to certain embodiments of the present disclosure, an example system for optimized well creation in a shale formation may comprise a bottom hole assembly (BHA), wherein the BHA comprises a drill bit and a logging while drilling LWD apparatus. A stimulation assembly may be coupled to the BHA. A control unit may be in communication with the LWD apparatus. The control unit may comprises a processor and a memory device, wherein the memory device contains a set of instructions that, when executed by the processor, cause the processor to receive first data from the LWD apparatus during a drilling operation; adjust a first planned stimulation location based, at least in part, on the first data, wherein the first planned stimulation location is based, at least in part, on a pre-determined model of a formation; receive second data from the LWD apparatus after the formation has been stimulated at the first planned stimulation location; and determine a second stimulation location based, at least in part, on the second data. In certain embodiments, the instructions, when executed by the processor, may further cause the processor to determine a second planned stimulation location within the formation based, at least in part, on the pre-determined model of the formation; and determine not to stimulate the formation at the second planned stimulation location based, at least in part, on the second data.

According to certain embodiments of the present disclosure, an example method for optimized well creation in a shale formation may comprise drilling a borehole with a downhole tool. The downhole tool may comprise a drill bit, a logging-while-drilling (LWD) assembly, and a stimulation assembly. The drill bit may be isolated from the stimulation assembly. The formation may be stimulated at a first location using the stimulation assembly. After stimulating the formation at the first location, first measurements from the formation at the LWD assembly may be received. Additionally, it may be determined whether to stimulate the formation at another location based, at least in part, on the first measurements. In certain embodiments, determining whether to stimulate the formation at another location based, at least in part, on the first measurements may comprise determining a second planned stimulation location within the formation based, at least in part, on the pre-determined model of the formation; and determining not to stimulate the formation at the second planned stimulation location based, at least in part, on the first measurements. In certain other embodiments, determining whether to stimulate the formation at another location based, at least in part, on the first measurements may comprise determining a second stimulation location based, at least in part, on the first measurements Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. The term "gas" is used within the scope of the claims for the sake of convenience in representing the various equations. It should be appreciated that the term "gas" in the claims is used interchangeably with the term "oil" as the kerogen porosity calculation applies equally to a formation containing kerogen that produces gas, and a formation containing kerogen that produces oil.

What is claimed is:

1. A method for optimized well creation in a shale formation, comprising:

prior to drilling a borehole in the shale formation, generating a well plan based, at least in part, on a-priori data corresponding to the shale formation, wherein the well plan includes at least a first planned stimulation location and a second planned stimulation location uphole from the first planned stimulation location;

drilling the borehole in the shale formation with a downhole tool based, at least in part, on the well plan;

adjusting the first planned stimulation location based, at least in part, on data received at the downhole tool while the downhole tool is drilling the borehole;

after drilling is completed, moving the downhole tool uphole to the adjusted first planned stimulation location;

stimulating the formation at the adjusted first planned stimulation location with the downhole tool;

determining not to stimulate the formation at the second planned stimulation location based, at least in part, on data received at the downhole tool after the formation has been stimulated at the adjusted first planned stimulation location.

2. The method of claim 1, wherein the downhole tool comprises:

a drill bit a logging while drilling (LWD) assembly; and a stimulation assembly.

3. The method of claim 2, further comprising isolating the drill bit from the stimulation assembly using a ball and seat mechanism.

4. The method of claim 1, further comprising:

determining an other stimulation location based, at least in part, on data received at the downhole tool after the formation has been stimulated at the adjusted first planned stimulation location.

5. The method of claim 1, further comprising introducing a completion string into the formation, wherein the completion string is configured to align with the adjusted first planned stimulation location.

6. The method of claim 5, wherein the completion string comprises at least one swell packer, and at least one opening that aligns with the adjusted first planned stimulation location.

7. A system for optimized well creation in a shale formation, comprising:

a bottom hole assembly (BHA), wherein the BHA comprises a drill bit and a logging while drilling LWD apparatus;

a stimulation assembly coupled to the BHA; and a control unit in communication with the LWD apparatus, wherein the control unit comprises a processor and a memory device, wherein the memory device contains a set of instructions that, when executed by the processor, cause the processor to:

receive a well plan generated prior to drilling a borehole in the shale formation and based, at least in part, on a-priori data corresponding to the shale formation, wherein the well plan includes at least a first planned stimulation location and a second planned stimulation location uphole from the first planned stimulation location;

receive first data from the LWD apparatus during a drilling operation;

adjust the first planned stimulation location based, at least in part, on the first data;

receive second data from the LWD apparatus after the formation has been stimulated at the adjusted first planned stimulation location; and determine not to stimulate the formation at the second planned stimulation location based, at least in part, on the second data.

8. The system of claim 7, wherein the BHA is coupled to the stimulation assembly through an isolation assembly.

9. The system of claim 7, further comprising a completion string, wherein the completion string is configured to align at least with the adjusted first planned stimulation location.

10. A method for optimized well creation in a shale formation, comprising:

prior to drilling a borehole in the shale formation, generating a well plan based, at least in part, on a-priori data corresponding to the shale formation;

drilling the borehole with a downhole tool, wherein the downhole tool comprises:

a drill bit;

a logging-while-drilling (LWD) assembly; and a stimulation assembly;

after drilling is completed, isolating the drill bit from the stimulation assembly and moving the downhole tool uphole to a first location;

stimulating the formation at a first location using the stimulation assembly, wherein the first location comprises a first planned stimulation location of the well plan adjusted based, at least in part, on data received at the downhole tool;

after stimulating the formation at the first location, receiving first measurements from the formation at the LWD assembly;

determining whether to stimulate the formation at another location based, at least in part, on the first measurements, wherein determining whether to stimulate the formation at another location based, at least in part, on the first measurements comprises determining not to stimulate the formation at a second planned stimulation location uphole from the adjusted first planned stimulation location based, at least in part, on the first measurements.

11. The method of claim 10, wherein isolating the drill bit from the stimulation assembly comprises using a ball and seat mechanism.

12. The method of claim 10, wherein the stimulation assembly comprises a hydrajet fracture tool.

13. The method of claim 10, wherein determining whether to stimulate the formation at an other location based, at least in part, on the first measurements comprises determining a new stimulation location based, at least in part, on the first measurements.

14. The method of claim 10, further comprising introducing a completion string into the formation, wherein the completion string is configured to align with the adjusted first planned stimulation location.

15. The method of claim 10, wherein the completion string comprises at least one swell packer, and at least one opening that aligns with the adjusted first planned stimulation location.

* * * * *